US008336266B2

(12) United States Patent
Scherrer

(10) Patent No.: US 8,336,266 B2
(45) Date of Patent: Dec. 25, 2012

(54) SYSTEM FOR FIXING STRETCHED WALLS OR CEILINGS BY WAY OF A STRINGER OF REDUCED SIZE

(75) Inventor: Jean-Marc Scherrer, Riedisheim (FR)

(73) Assignee: Normalu, Kemps (FR)

( * ) Notice: Subject to any disclaimer, the term of this patent is extended or adjusted under 35 U.S.C. 154(b) by 0 days.

(21) Appl. No.: 12/812,430

(22) PCT Filed: Jan. 9, 2009

(86) PCT No.: PCT/FR2009/000021

§ 371 (c)(1),
(2), (4) Date: Aug. 4, 2010

(87) PCT Pub. No.: WO2009/106762

PCT Pub. Date: Sep. 3, 2009

(65) Prior Publication Data

US 2011/0061320 A1 Mar. 17, 2011

(30) Foreign Application Priority Data

Jan. 9, 2008 (FR) ..... 08 00124

(51) Int. Cl.

| | |
|---|---|
| ***E04B 1/00*** | (2006.01) |
| ***E04B 5/00*** | (2006.01) |
| ***E06B 3/80*** | (2006.01) |
| ***A47H 13/00*** | (2006.01) |

(52) U.S. Cl. ..... 52/273; 52/222; 160/327; 160/395; 160/398

(58) Field of Classification Search ..... 52/222, 52/273, 63; 160/395, 392, 327, 398, 403
See application file for complete search history.

(56) References Cited

U.S. PATENT DOCUMENTS 3,405,489 A * 10/1968 Per ..... 52/222

(Continued)

FOREIGN PATENT DOCUMENTS

DE 6600406 1/1969

(Continued)

OTHER PUBLICATIONS

English abstract of FR 2843141.

(Continued)

*Primary Examiner* — Joshua J Michener
*Assistant Examiner* — Ryan Kwiecinski
(74) *Attorney, Agent, or Firm* — Olser, Hoskin & Harcourt LLP

(57) ABSTRACT

The invention relates to a system for attaching false stretched walls made of a flexible sheet (1) attached by the edges thereof to a mini-stringer (3'), said edges being provided with a harpoon-type hook (11) inserted as a gooseneck between the two flanges of the stringer (3') and including a first section (11*a*) connected to the sheet (1) and a second section (11*b*) folded on the first one, and having an end bead bearing onto a shoulder (8) of the outer flange (5) of said stringer, characterised in that the end bead of the harpoon (11) includes a disconnection lip (12) extending perpendicularly from the bearing area of the bead on the shoulder (8), and extending under said shoulder (8) in the gap of the stringer (3') so that said lip (12) can be used as a lever for urging the end of the harpoon (11) out of the shoulder (8), without any penetration of an application tool in the stringer (3'), in order to easily dismantle said sheet (1).

6 Claims, 1 Drawing Sheet

U.S. PATENT DOCUMENTS

| | | | | | |
|---|---|---|---|---|---|
| 4,083,157 | A | * | 4/1978 | Anthonioz | 52/222 |
| 5,029,422 | A | * | 7/1991 | Scherrer | 52/222 |
| 5,058,340 | A | * | 10/1991 | Muller | 52/222 |
| 5,380,120 | A | * | 1/1995 | Vermeulen | 52/63 |
| 7,607,268 | B2 | * | 10/2009 | Scherrer et al. | 52/273 |
| 2006/0156667 | A1 | * | 7/2006 | Scherrer et al. | 52/506.07 |

FOREIGN PATENT DOCUMENTS

| | | | | |
|---|---|---|---|---|
| EP | 0043466 | | | 1/1982 |
| EP | 43466 | A2 | * | 1/1982 |
| FR | 002827621 | | * | 7/2001 |
| FR | 2843141 | | | 2/2004 |
| GB | 1129635 | | | 10/1968 |
| WO | WO 2010071271 | A1 | * | 6/2010 |

OTHER PUBLICATIONS

English abstract of EP0043466.

International Search Report from PCT/FR2009/000021 dated Aug. 27, 2009; Stern, Claudio.

* cited by examiner

SYSTEM FOR FIXING STRETCHED WALLS OR CEILINGS BY WAY OF A STRINGER OF REDUCED SIZE

CROSS-REFERENCE TO RELATED APPLICATIONS

The present application is the U.S. National Stage of PCT/FR2009/000021 filed Jan. 9, 2009. The present application claims the benefit of priority to French patent application no. 08 00124 filed Jan. 9, 2008. Both of these applications are incorporated herein by reference.

FIELD OF THE INVENTION

The present invention relates to the field of false walls such as false ceilings and false walls and in particular those constituted by a stretched flexible sheet hooked along its edges to a support fixed to the walls or ceiling of a room of a building.

BACKGROUND OF THE INVENTION

Patent FR2 630 476 in the name of Fernand SCHERRER especially discloses false stretched ceilings which comprise both a frame fixed to the walls or to the ceiling of a room, this frame being formed by an external stringer in turn comprising butted profiles, and also a stretched flexible sheet inside this frame, this flexible sheet comprising a sheet of plastic material or a fabric. The flexible sheet is kept stretched due to hooking, on the stringer, of a border solid with the sheet forming a harpoon, this border having a cross-section in the form of a hook clinging to a shoulder extending over the entire periphery of the external flange of the stringer.

These known false walls rest on the principle of tensing the flexible sheet on the frame, perfectly flat, horizontally or vertically according to whether it is a false ceiling or a false wall.

Once mounted on their stringer these false ceilings or false walls necessarily frequently show considerable and therefore visible clearance between the periphery of the stretched wall and the walls supporting the hooking stringers. This functional clearance necessarily results from the need to provide sufficient gap between the wall and the stretched surface to insert the peripheral hooks of the sheet inside the stringers such that the end bead of the harpoon fits into a shoulder provided for this purpose on the external flange of the stringer nearest the wall, as shown in FIG. 1, for example.

This residual gap enabling assembly and especially disassembly by insertion of a spatula inside the hook of the sheet is now of the order of 4 to 5 mm minimum.

In numerous cases, this residual gap between the sheet and the wall can be visually offputting as it comprises a hollow joint sometimes giving a highly unaesthetic impression; this the case especially when fabrics are stretched in rooms where the wall and the ceiling must not include any hollow joint to get better presentation; similarly, in numerous installations it is important that the hollow joint between the fabric and the walls be as small as possible to avoid unintended passages of air causing smearing or which are likely to unbalance some aeration installations.

OBJECT AND SUMMARY OF THE INVENTION

The aim of the present invention therefore is to eliminate such disadvantages by proposing a fixing system for a stretched wall, for example a ceiling between two walls leaving only a very slight hollow joint, of the order of 3 mm, that is, almost invisible to the eye after assembly of said ceiling.

In keeping with the invention, a fixing system for false stretched walls is therefore proposed, constituted by a flexible sheet hooked by its borders to a frame fixed to the wall or ceiling of a room, said frame comprising a stringer formed by butted profiles comprising at least two advantageously parallel flanges whereof one, known as external, comprises on one side means for fixing to the wall or ceiling and on the other side having a shoulder extending perpendicularly to the interior of the stringer in the direction of the room and whereof the other, known as internal, is connected to the first by a web located at one of its ends and extends at the other end slightly beyond the shoulder of the first flange to form the peripheral support of the sheet which is stretched substantially perpendicularly to the internal flange due to its borders fitted with a hook in the general shape of a harpoon inserted as a "gooseneck" between the two flanges of the stringer and formed by a first section by which it is connected to the sheet and a second section folded back on the first whereof the end bead is supported on the shoulder of the external flange; the system is remarkable in that said end bead of the harpoon comprises a disconnection lip coming perpendicularly from the support zone of said bead on the shoulder providing hooking of the sheet on the stringer and extending under said shoulder in the gap made between the latter and the internal flange of the stringer such that said lip serves as lever for an application tool, pushing the end bead of the harpoon out of the shoulder, without the tool penetrating into the stringer, for easily disassembling the sheet from its frame.

It is understood that with using a type of harpoon according to the invention, there is no longer a need in disassembly of false ceilings or false walls to insert a disassembly spatula inside the hook to disengage it from the shoulder of the stringer, as is obligatory in current procedures with known systems; the gap necessary for sliding the spatula blade is necessarily augmented by the thickness of the spatula such that is proved impossible to reduce the size of the stringers. On the contrary, with the invention the unhooking of fabrics is done by simple support on the unhooking lip coming under the stringer, making it easy to disengage the harpoon from the shoulder and therefore to unhook the sheet.

BRIEF DESCRIPTION OF THE DRAWINGS

Other advantages and characteristics will emerge from the following description of a variant embodiment of the fixing system according to the invention in reference to the attached figures, in which.

DETAILED DESCRIPTION

Figure 1:
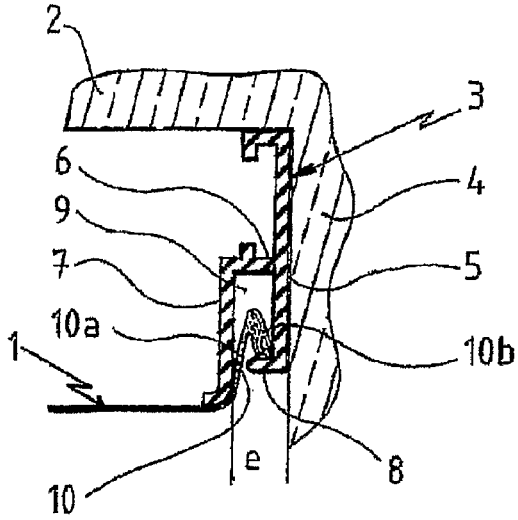
fig. 1 PRIOR ART
FIG. 1 is a view in partial vertical section of a false ceiling comprising a stretched sheet and comprising a stringer fixed to the upper part of a wall of a room according to the prior art.

FIG. 1 shows the end part of a false ceiling as per the prior art, which comprises a flexible sheet 1 stretched horizontally below the ceiling 2 of a room. This sheet 1 is fixed along its edges to a support comprising a horizontal stringer 3, in turn fixed to the upper part of a wall 4 of the room by appropriate means, not shown, such as screws. This stringer 3 comprises an external vertical flange 5 which extends parallel to the wall 4 and very close to the latter. Coming off this external vertical flange 5 at around mid height is an upper horizontal web 6 extending over a short distance, for example of the order of 7 mm, to the interior of the room. This web 6 is prolonged at its end by an internal vertical flange 7 extending downwards slightly lower than the external flange 5 near the wall 4, that is, the internal flange 7 is slightly higher than the external flange 5 of said stringer. This external flange 5 has, at its lower end, a shoulder 8 extending horizontally towards the interior of the room, over a short distance which is for example 3 mm. This square shoulder 8 advantageously has a rounded end.

The lower part of the external vertical flange 5, the upper horizontal web 6 and the vertical flange 7 determine a recess 9 open downwards and in which the welded fixing harpoon 10 can engage at the periphery of the stretched flexible sheet 1.

This harpoon 10 has a cross-section in the form of a hook extending towards the wall 4 and open downwards. It comprises an internal leg 10*a*, or flange, by which it is connected to the sheet 1, and an external leg 10*b* in the form of a bead at the rounded end, which is curved downwards. When the sheet 1 is stretched the harpoon 10 is supported on the shoulder 8 by the lower end of its external leg 10*b* which extends downwards.

This harpoon 10 is simply supported on the lower horizontal shoulder 8 by its bead 10*b* which consequently makes its hooking positioning much easier. In fact, during assembly of the stretched fabric, it suffices to push the harpoon 10 back up into the recess 9, using an appropriate tool such as a spatula engaged in this harpoon 10, to make it pass between the shoulder 8 and the vertical flange 7 and bring it above the shoulder 8. When the harpoon 10 is released, the latter is then supported on the shoulder 8, ensuring that the stretched sheet 1 is kept in place, because of spring effect between the two legs of the harpoon caused by the material from which the latter is made and the traction exerted on the internal leg 10*a* by the sheet 1. Said spring effect comprises bringing the two legs together. The angle formed between the two legs of the harpoon in position is under 15°.

Figure 2:
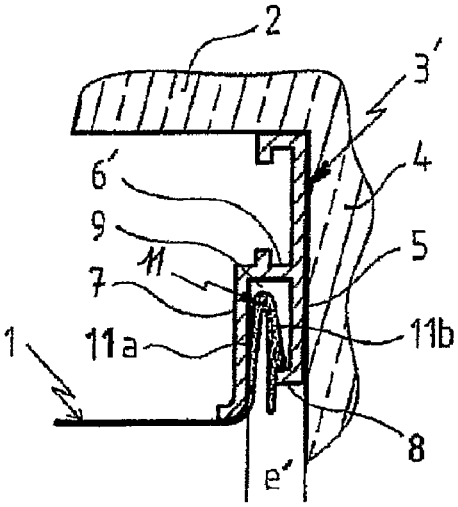
FIG. 2 is a view in partial vertical section, on the same scale and according to the same angle of view of FIG. 1, of a false ceiling comprising a stretched sheet on a stringer finer than that shown in FIG. 1 and hooked thereto by a fixing system according to the invention.

FIG. 2 illustrates the end part of a false ceiling according to the invention, as earlier comprising a flexible sheet 1 stretched horizontally below the ceiling 2 of a room. This sheet 1 is fixed along its edges to a support constituted by a stringer 3' different to the stringer 3 (FIG. 1) of the prior art in that the web 6' is shorter than the web 6 of the stringer 3.

In this way, the residual gap e' between the periphery of the sheet 1 and the walls 4 supporting the stringers 3' is reduced relative to the gap e of FIG. 1 in the same proportions.

This reduction of the clearance e resulting from using a stringer 3' with reduced web 6', hereinbelow referred to as mini stringer, is particularly advantageous, as already mentioned in the preamble.

As much as assembling the sheet 1 in a mini stringer 3' is relatively easy using a traditional spatula, already used in the prior art, by pushing back the harpoon 11 inside the gap 9 of the stringer 3' to snap-lock the end bead of the harpoon 11 on the shoulder 8 of the flange 5 of the mini stringer 3', just as much it can be difficult, or even impossible, to unhook the sheet 1 conventionally by pushing back the harpoon 11 so that it unhooks from the shoulder 8; in fact, the passage for the spatula between the two flanges 11*a* and 11*b* of the harpoon is just sufficient in the interval between the shoulder 8 and the flange 7 of the mini stringer 3'; in these conditions, the difficulty in disengaging the harpoon 11 from the shoulder 8 and therefore the difficulty of disassembling the sheet 1 with this type of reduced stringer 3' is understood.

This is the reason why, and in keeping with the invention, the harpoon 11 fitted on fabrics 1 to be mounted on mini stringers 3' comprises at the free end of the flange 11*b* a disconnection lip 12, coming perpendicularly from the zone of the end bead supported on the shoulder 8 to cause hooking of the sheet 1 onto the stringer 3'; this lip 12 is such that it can extend under said shoulder 8 into the gap between said shoulder and the internal flange 7 of the stringer 3' such that the lip 12 can serve as lever for an application tool, for example a conventional spatula, allowing the end bead of the harpoon 11 to be pushed out of the shoulder 8 without it having to penetrate said spatula in the mini stringer 3' for easily disassembling the sheet 1 from its frame.

Figure 3:
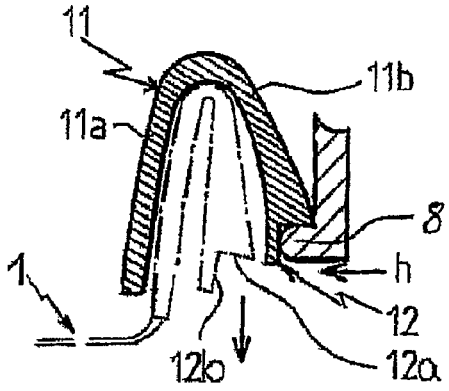
FIG. 3 is a partial illustration on a larger scale of the harpoon comprising the fixing system of the sheet as per FIG. 2.

According to a particular variant shown on an enlarged scale in FIG. 3, the lip 12 coming from the end bead of the harpoon 11 is obtained by a peripheral cutout towards the exterior of said harpoon 11, whereof the cross-section has the general shape of a re-entrant quadrant whereof the radial face 12*a* cooperates with the shoulder 8 of the mini stringer 3' and the axial face 12*b* extends against said shoulder 8 and slightly beyond its thickness to constitute the disconnection lip 12.

So, when the sheet 1 hooked on a mini stringer 3' is to be disassembled, a conventional disassembly spatula (not shown in the figures) is used for example, but it is not inserted between the flanges 11*a* and 11*b* of the harpoon 11 inside the gap 9 of the mini stringer 3'; the blade of the spatula is used to push the lip 12 back towards the sheet 1 (arrow h, FIG. 3) against the linking flange 11*a* of the harpoon 11 on the sheet 1 until the radial face 12*a* of the end unhooks from the harpoon resting on the shoulder 8 of the mini stringer 3', the effect of which is to extract the harpoon 11 downwards (arrow v, FIG. 3) and therefore the sheet 1 is unhooked from the mini stringer 3'.

Figure 4:
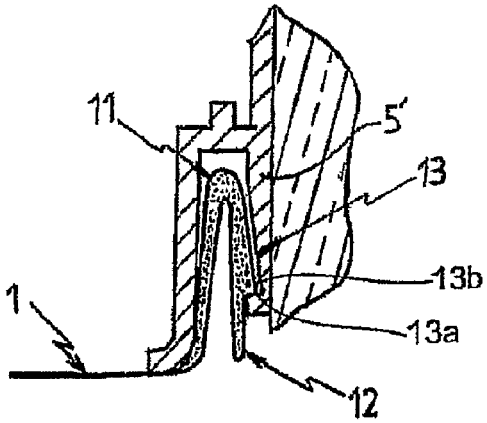
FIG. 4 is a partial illustration on a larger scale of the harpoon of FIG. 3 cooperating with a variant stringer in which the shoulder is replaced by a notch made in the external flange.

According to a final particularly advantageous variant shown in FIG. 4, the shoulder 8 provided on the external flange 5 of the preceding variants serving as support at the bead end of the harpoon 11 is replaced by a notch 13 made in the thickness of the external flange 5 of the mini stringer 3' to serve as support zone to said end bead of the harpoon 11.

According to a preferred configuration, the notch 13 has a general shape of a right triangle whereof the short side 13*a* of the right angle, perpendicular to the plane of the external flange 5 of the mini stringer 3', serves as support at the bead end of the harpoon 11 and whereof the hypotenuse 13*b* makes engagement of the bead of the harpoon 11 easy during assembly of the fabric 1.

The harpoon 11 is assembled on the mini stringer 3' in exactly the same way as previously by guiding for example the radial face 12*a* of the end of the harpoon 11 to coincide on the support face 13*a* of the notch 13; the disassembly tab 12 is now supported on the internal face of the external flange 5 of the mini stringer 3', subsequently enabling disassembly completely the same as what has been described for the preceding variant. The interest in this final variant is evident in that it is possible to further reduce the web 6' of the mini stringer 3' by a magnitude equivalent to the projection of the shoulder 8, and consequently further reduce the residual and unaesthetic clearance between the stretched sheet 1 and the wall 4.

It is understood that the quadrant cutout of the end bead of the harpoon 11 to make the disconnection lip 12 is given only by way of non-limiting example of the invention and any other form of cutout of the end bead is feasible without departing from the scope of the invention.

The invention claimed is:

1. A fixing system for false stretched walls, constituted by a flexible sheet hooked by borders to a frame fixed to the wall or ceiling of a room, said frame comprising a stringer formed by butted profiles comprising at least two parallel flanges, comprising an external flange and an internal flange, said external flange comprising on one side means for fixing to the wall or ceiling and on an other side a shoulder extending perpendicularly to an interior of the stringer in the direction of the room, said internal flange being connected to said external flange by a web located at an end thereof and extending to an other end beyond the shoulder of said external flange to form a peripheral support of the sheet which is stretched substantially perpendicularly to said internal flange by said borders fitted with a hook in a general shape of a harpoon inserted between the flanges of the stringer and formed by a first section which is connected to the sheet and a second section folded back on the first section wherein an end bead is supported on the shoulder of the external flange, wherein said end bead of the harpoon comprises a disconnection lip coming perpendicularly from a support zone of said bead on the shoulder providing hooking of the sheet on the stringer and extending under said shoulder into a gap between said external flange and said internal flange of the stringer such that said lip serves as a lever for an application tool, enabling the end of the harpoon to be pushed out of the shoulder without the tool penetrating into the stringer, to detach the sheet from said frame.

2. The fixing system as in claim 1, wherein the end bead of the harpoon comprises a peripheral cutout towards the exterior of said harpoon, said peripheral cutout having a cross-section in a general shape of a re-entrant quadrant, said peripheral cutout having a radial face cooperating with the shoulder of the stringer and an axial face extending against said shoulder and beyond a thickness of said shoulder to constitute the disconnection lip.

3. A fixing system for false stretched walls, constituted by a flexible sheet hooked by borders to a frame fixed to the wall or ceiling of a room, said frame comprising a stringer formed by butted profiles comprising at least two parallel flanges comprising an external flange and an internal flange, said external flange comprising on one side means for fixing to the wall or ceiling and on an other side a notch made in a thickness of the external flange of the stringer, said internal flange being connected to said external flange by a web located at an end thereof and extending to an other end beyond the notch of said external flange to form a peripheral support of the sheet which is stretched substantially perpendicularly to said internal flange by said borders fitted with a hook in a general shape of a harpoon inserted between the flanges of the stringer and formed by a first section which is connected to the sheet and a second section folded back on the first section wherein an end bead is supported on the notch of the external flange, wherein said end bead of the harpoon comprises a disconnection lip coming perpendicularly from a support zone of said bead on the notch providing hooking of the sheet on the stringer and extending under said notch into a gap between said external flange and said internal flange of the stringer such that said lip serves as a lever for an application tool, enabling the end of the harpoon to be pushed out of the notch without the tool penetrating into the stringer, to detach the sheet from said frame.

4. The fixing system as in claim 3, wherein the notch has a general shape of a right triangle, wherein a short side of a right angle of the right triangle, perpendicular to a plane of the external flange, acts as support at the end bead of the harpoon and wherein a hypotenuse of the right triangle facilitates engagement of the end bead of the harpoon during assembly of the sheet.

5. The fixing system as in claim 3, wherein the end bead of the harpoon comprises a peripheral cutout towards the exterior of said harpoon, said peripheral cutout having a cross-section in a general shape of a reentrant quadrant, said peripheral cutout having a radial face cooperating with the notch of the stringer and an axial face extending against said notch and beyond a thickness of said shoulder to constitute the disconnection lip.

6. The fixing system as in claim 5, wherein the notch has a general shape of a right triangle, wherein a short side of a right angle of the right triangle, perpendicular to a plane of the external flange, acts as support at the end bead of the harpoon and wherein a hypotenuse facilitates engagement of the end bead of the harpoon during assembly of the sheet.

* * * * *